US005479919A

United States Patent [19]

Buchtal

[11] Patent Number: 5,479,919

[45] Date of Patent: Jan. 2, 1996

[54] DEVICE FOR PUTTING INTO OPERATION AN OXYGEN-RELEASING CARTRIDGE IN A RESPIRATOR

[75] Inventor: Ralf Buchtal, Lübeck, Germany

[73] Assignee: Drägerwerk AG, Lübeck, Germany

[21] Appl. No.: 252,445

[22] Filed: Jun. 1, 1994

[30] Foreign Application Priority Data

Jul. 1, 1993 [DE] Germany ..... 43 21 926.8

[51] Int. Cl.[6] ..... A62B 7/00

[52] U.S. Cl. ..... 128/202.27; 128/200.24; 128/202.26

[58] Field of Search ..... 128/200.24, 205.24, 128/204.18, 202.22, 202.24, 202.25, 202.26, 202.27

[56] References Cited

U.S. PATENT DOCUMENTS 3,019,788 2/1962 Hughes ..... 128/205.24
3,938,764 2/1976 McIntyne et al. ..... 244/117

FOREIGN PATENT DOCUMENTS 706351 5/1941 Germany .
3002404 8/1980 Germany .

*Primary Examiner*—Edgar S. Burr
*Assistant Examiner*—V. Srivastava
*Attorney, Agent, or Firm*—McGlew and Tuttle

[57] ABSTRACT

A device for actuating an ignition mechanism of an oxygen-releasing mechanism in a respirator, with a striker spring fastened in a mounting support and with a striking hammer, which is located at the free end of the striker spring and actuates the ignition mechanism. The striking hammer can be released several times in succession, whereby the replacement of the cartridge is facilitated. The device is provided with a release lever, which can be pivoted from a starting position around a fixed axis and has a tensioning tongue, which extends, at least partially, below the free end of the striker spring and deflects the striker spring in the pretensioning direction. The release lever has a return member automatically restoring the starting position. The mounting support and the axis are fastened to the receiving housing of the respirator, which accommodates the cartridge.

4 Claims, 3 Drawing Sheets

DEVICE FOR PUTTING INTO OPERATION AN OXYGEN-RELEASING CARTRIDGE IN A RESPIRATOR

FIELD OF THE INVENTION

The present invention pertains to a device for actuating a starting device of an oxygen-releasing cartridge, preferably for use in an airplane, in a respirator, with a striker spring fastened in a mounting in the manner of a cantilever and with a striking hammer, which is located at the free end of the striker spring and actuates the starting device from a pretensioned position of the striker spring.

BACKGROUND OF THE INVENTION

A device of this type has become known from German Patent No. DE-PS 706,351. The end of a striker spring is clamped in a mounting on the bottom of an oxygen-releasing cartridge, and a striking hammer, which is located opposite the starting device of the cartridge, is fastened at the free end of the striker spring. The striking hammer is held securely by a spring, which is located on the bottom of the storage container of the cartridge, tensions the striker spring when the cartridge is removed, and releases the striking hammer at a defined spring tension of the striker spring. As a result, the starting device is actuated, and the oxygen-releasing cartridge is put into operation.

One disadvantage of the prior-art device is the fact that the spring that holds the striking hammer securely is located in an area of the storage container which is extensively inaccessible to the user, as a result of which it is difficult to hook the striking hammer into the spring. In addition, it may happen that the striking hammer jumps prematurely out of the spring due to tilting of the cartridge during its removal from the storage container, as a result of which the pretension of the striker spring, which is necessary for the reliable release of the starting device, will not be achieved. A repeated, immediate actuation of the starting device is not possible in this case. In addition, the mounting with the striker spring must be removed from the cartridge housing of the used cartridge during the removal of the cartridge, and it must again be fastened to the new cartridge. This makes rapid replacement of the cartridge difficult.

A respirator with an oxygen-releasing cartridge, in which the starting device of the cartridge is actuated by a striking hammer fixed in a pretensioned position, has become known from DE-A 30,02,404. The striking hammer and the striker spring belonging to it are fastened to the bottom part of the cartridge, and the striking hammer is held in the pretensioned position by a release lever. When the cartridge is placed into a receiving housing, the striking hammer is released by pivoting the release lever.

The disadvantage of the prior-art device is the fact that the striker spring connected to the cartridge also must be replaced, together with the striking hammer, when the cartridge is replaced. This makes the cartridge expensive. In addition, the starting device of the cartridge can be actuated only once when introduced into the receiving housing.

SUMMARY AND OBJECTS OF THE INVENTION

The basic object of the present invention is to improve a device of the type described such that the striking hammer actuating the starting device mechanism can be released several times in succession, and replacement of the cartridge is facilitated.

This object is attained by the device being provided with a release lever, which can be pivoted from a starting position around a fixed axis and has a tensioning tongue, which extends at least partially below the free end of the striker spring and deflects the striker spring into the pretensioned position, and by the release lever having a return member, which automatically restores the starting position, and by the mounting and the axis being fastened to the receiving housing of the respirator, which accommodates the cartridge.

The advantage of the present invention is essentially the fact that the striker spring can be deflected several times in a rapid succession due to the self-resetting release lever, which extends at least partially below the striker spring, and that the starting device can also be actuated several times in succession from the pretensioned position of the striker spring, when necessary, due to the jumping back of the striking hammer. Another advantage of the present invention is the fact that the release lever and the mounting with the striking hammer are fastened to the receiving housing accommodating the cartridge, so that the device actuating the starting device remains in the respirator when the cartridge is replaced and it can be immediately reused with a newly introduced cartridge.

The device according to the present invention operates in such a way that the tensioning tongue extends below the striker spring in the course of the pivoting movement of the release lever and brings it into a pretensioned position, and the overlap between the tensioning tongue and the striker spring decreases in the course of the pivoting movement, and the tensioning tongue finally becomes completely disengaged from the striker spring at a defined deflection position. The striker spring then jumps back into the starting position and actuates the starting device of the cartridge in the process. The release lever is again brought into its starting position by means of a return member. The striker spring is now slightly deflected by the tensioning tongue in the direction of the starting device, until the tensioning tongue has slid past the tip of the striker spring, after which both the striker spring and the release lever have reached the starting position, i.e., the resting position.

The return member is advantageously designed as a torsion spring, which is attached to the axis of the release lever and is supported on the release lever, on the one hand, and on a bearing block receiving the axis, on the other hand.

The return of the release lever into the starting position is advantageouslyimproved by the tensioning tongue of the release lever having— at least in the part overlapped by the striker spring—a cutout, which is open toward the free end of the striker spring, with contact surfaces surrounding the cutout in the manner of a frame, with which contact surfaces a flexible tongue-like leaf spring covering the cutout is in contact. The leaf spring is fastened on the opposite side of the open part of the cutout such that a deflectability of the leaf spring in the pretensioning direction of the striker spring is set. Consequently, if the release lever is deflected from the resting position, the leaf spring lies on the contact surfaces, and deflection of the striker spring is possible. When the release lever is pivoted back, the leaf spring is raised by the tip of the striker spring, and this happens shortly before the tensioning tongue has returned into the starting position. Consequently, only the spring force of the leaf spring must be overcome when the release lever is pivoted back.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENTS

Figure 1:
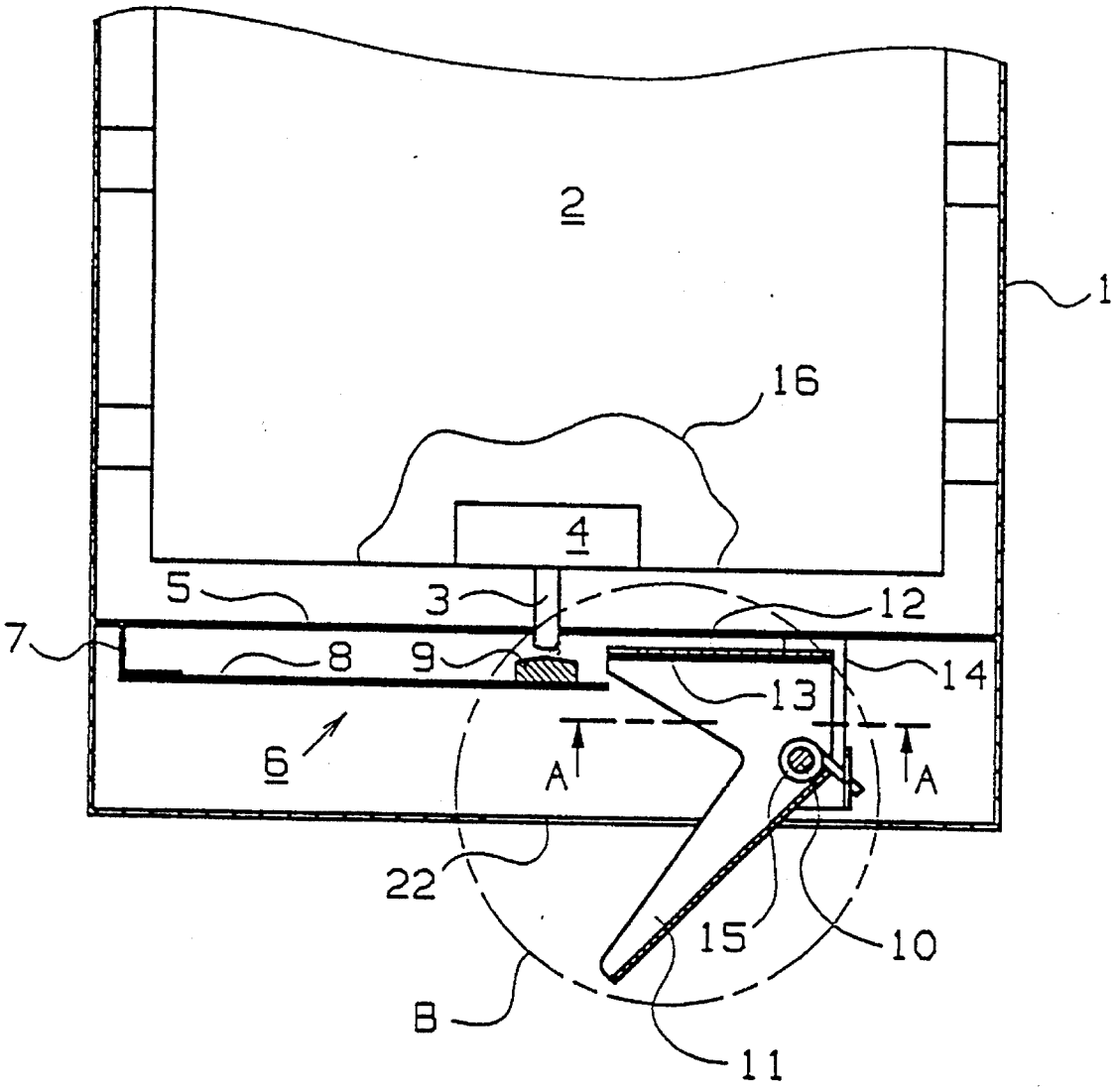
FIG. 1 is a longitudinal sectional view of a receiving housing for an oxygen-releasing cartridge with a device for actuating a starting device of the cartridge.

FIG. 1 shows a longitudinal section of a partial view of a receiving housing 1 for an oxygen-releasing cartridge 2, which is put into operation by a strike on a pin 3 of a starting device 4 located in the cartridge 2. To represent the starting device 4, the cartridge 2 is cut up along the section line 16. A device 6 for actuating the starting device 4 is located on the bottom 5 of the receiving housing 1, with a striker spring 8 fastened with a mounting 7 with a striking hammer 9 at the free end of the striker spring 8, with a release lever 11 pivotable around an axis element 10 with a tensioning tongue 12 as part of the release lever 11, and with a leaf spring 13 lying on the tensioning tongue 12. The release lever 11 is mounted on the fixed axis 10 for pivoting from a starting position in a deflected position. The axis element 10 is arranged on a bearing block 14. The bearing block 14 is fastened, in the same manner as the mounting 7, on the bottom 5 of the receiving housing 1. A torsion spring 15 is provided as a return member. The torsion spring 15, is supported on the release lever 11, on the one hand, and on the bearing block 14, on the other hand. The torsion spring 15 returns the release lever 11, brought into the deflected position, into the starting position shown in FIG. 1, is attached to the axis element 10. The torsion spring 15 is represented in FIG. 1 only schematically. The release lever 11 can be operated via an opening 22 in the receiving housing 1.

Figure 2:
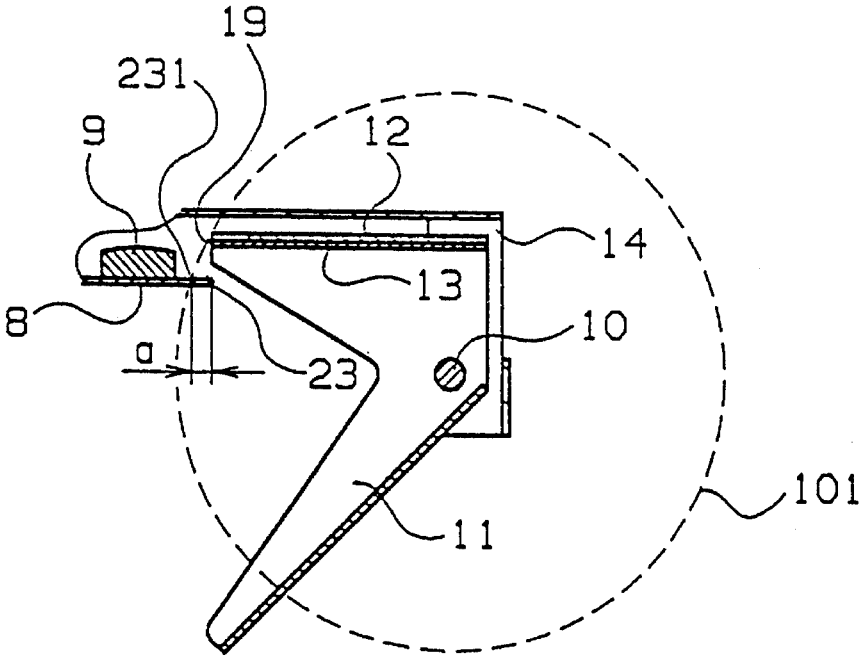
FIG. 2 is a view of detail B of the device according to FIG. 1.

To illustrate the interaction between the striker spring 8, the tensioning tongue 12 and the leaf spring 13 during the pivoting movement of the release lever 11, detail B in FIG. 1 is shown on an enlarged scale in FIG. 2. Identical components are designated with the same reference numerals as in FIG. 1. During the pivoting of the release lever 11, the front edge 19 of the leaf spring 13 moves along a circular path 101 around the axis 10, which is illustrated by a broken line in FIG. 2. The circular path 101 intersects the striker spring 8 at the point of intersection 231. The section between the point of intersection 231 and the tip 23 of the striker spring 8 is the maximum overlapped section a, which is an indicator of the extent of the deflection of the striker spring 8. The overlap of the striker spring 8 with the tensioning tongue 12 depends, in general, on the pivoting position of the release lever 11. The maximum overlap, the overlapped section α, occurs in this case when the front edge 19 of the leaf spring 13 touches the striker spring 8 located in the starting position at the point of intersection 231.

Figure 3:
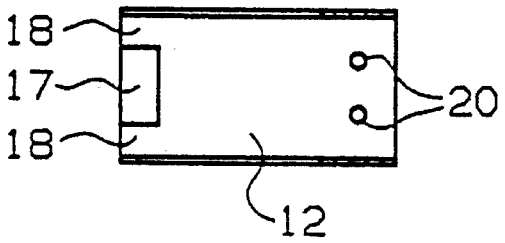
FIG. 3 is a sectional view A-A of the release lever of the device according to FIG. 1.
Figure 4:
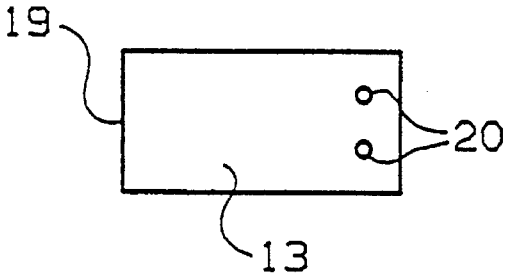
FIG. 4 is a top view of a leaf spring in direction A—A according to FIG. 1.

FIG. 3 shows the sectional view A-A of the release lever 11 according to FIG. 1 with a view toward the tensioning tongue 12. The tensioning tongue 12 has a cutout 17, which is open toward the striker spring 8, with contact surfaces 18 surrounding the cutout 17 in the manner of a frame. The cutout 17 and the contact surfaces 18 are covered by a leaf spring 13, which is represented in FIG. 4 and is connected to the tensioning tongue 12 in the manner of a flexible tongue at fastening holes 20 by means of screws passed through, which are not shown in FIGS. 1 through 4.

Figure 5:
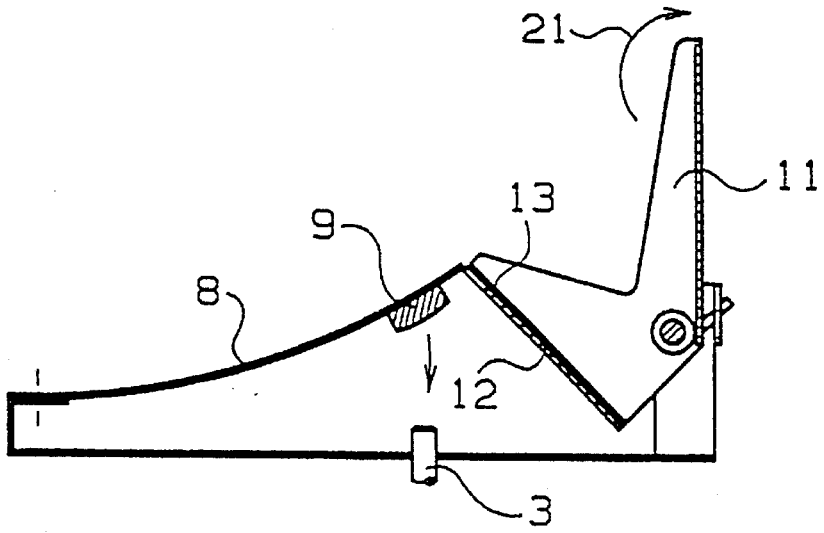
FIG. 5 is a side view of the device according to FIG. 1 with deflection of the striker spring in the pretensioning direction.
Figure 6:
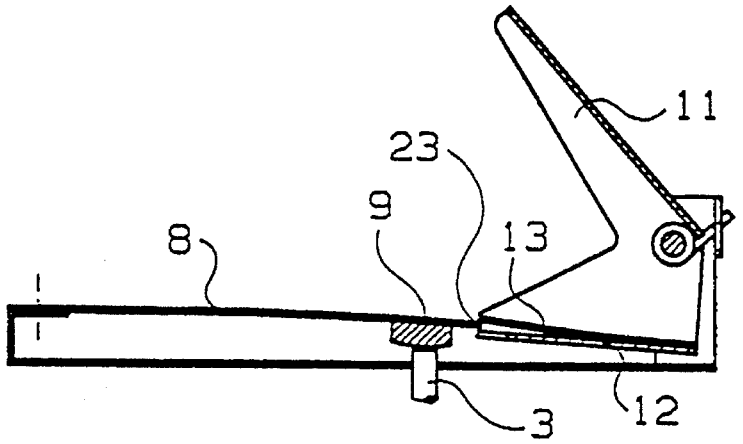
FIG. 6 is the device according to FIG. 5 when the release lever is being pivoted back into the starting position.

The actuation of the starting device 4 of the cartridge 2 via the pins 3 is represented in FIGS. 5 and 6. If the release lever 11 is deflected in the direction of the arrow 21, the striker spring 8 is brought into the pretensioned position by the tensioning tongue 12 with the leaf spring 13 located on it. The extent of the deflection of the striker spring 8 depends on the overlapped section a. The maximum pretensioned position of the striker spring 8 is shown in FIG. 5. The striker spring 8 is released on further rotation of the release lever 11 in the direction of the arrow 21, and the striking hammer 9 hits the pin 3, as a result of which the starting device 4 is activated.

The pivoting back of the release lever 11 into the starting position is illustrated in FIG. 6.

During pivoting back, the tip 23 of the striker spring 8 extends below the cutout 17 of the tensioning tongue 12, as a result of which the leaf spring 13 is raised from the contact surfaces 18 (FIG. 3 and FIG. 4) and is deflected to the extent that the tensioning tongue 12 will again reach the starting position past the striker spring 8. As soon as the leaf spring 13 no longer overlaps with the striker spring 8 due to its deflection, it snaps back and again lies on the contact surfaces 18. FIG. 6 shows the leaf spring 13 deflected by the tip 23 of the striker spring 8. Since the leaf spring 13 is needed only to enable the release lever 11 to pivot back, it can be designed as an especially elastic leaf spring, because it already lies on the contact surfaces 18 of the tensioning tongue 12 during the deflection of the striker spring. When the release lever 11 is pivoted back into the starting position, the leaf spring 13 is deflected in the pretensioning direction of the striker spring 8.

Figure 7:
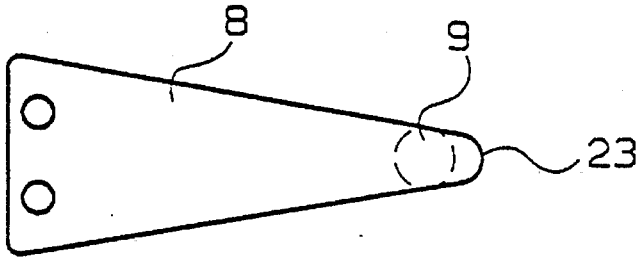
FIG. 7 is a top view of the striker spring.

FIG. 7 shows an advantageous design of the striker spring 8, viewed in the direction of the striker spring 8. The leaf-shaped striker spring 8 has a trapezoidal design, so that an approximately constant bending tension is present over the entire length of the striker spring.

While a specific embodiment of the invention has been shown and described in detail to illustrate the application of the principles of the invention, it will be understood that the invention may be embodied otherwise without departing from such principles.

What is claimed is:

1. A device for actuating a starting device of an oxygen-releasing cartridge, the cartridge supplying oxygen for respiration, the device comprising: respirator receiving housing, said respirator receiving housing accommodating said oxygen-releasing cartridge; a mounting support fastened to said respirator receiving housing; a striker spring fastened to said mounting support and extending in a cantilevered manner; a striking hammer disposed at a free end of said striker spring, said striker spring being deflectable to a pretensioned position allowing said striker spring to move, for moving said striker hammer, for actuating the starting device; a fixed axis member mounted to said respirator receiving housing; a release lever mounted on said fixed axis member for pivoting from a starting position toward a striker spring pretensioned position, said release lever including a tensioning tongue movable with said release lever and a leaf spring connected to said tensioning tongue, said leaf spring being deflectable in a direction away from said striker spring pretensioned position, said tensioning tongue and said leaf spring mounted on said tensioning tongue extending at least partially behind said free end of said striker spring for deflecting said striker spring toward said pretensioned position; a return member connected to said release lever for automatically restoring said release lever to said starting position.

2. Device according to claim 1, wherein said return member is a torsion spring fastened to said fixed axis.

3. A device for actuating a starting device of an oxygen-releasing cartridge, the cartridge supplying oxygen for respiration, the device comprising: respirator receiving housing, said respirator receiving housing accommodating said oxygen-releasing cartridge; a mounting support fastened to said respirator receiving housing; a striker spring fastened to said mounting support and extending in a cantilevered manner; a striking hammer disposed at a free end of said striker spring, said striker spring being deflectable from a rest position to a pretensioned position allowing said striker spring to move for moving said striker hammer to said starting device for actuating the starting device; a fixed axis member mounted to said respirator receiving housing; a release lever mounted on said fixed axis member for pivoting from a starting position toward a striker spring pretensioned position, said release lever including a tensioning tongue movable with said release lever and a leaf spring connected to said tensioning tongue, said leaf spring being deflectable in a direction away from said striker spring pretensioned position, said tensioning tongue including a part extending at least partially behind said free end of said striker spring, said part including a cutout open toward said free end of said striker spring, said tensioning tongue defining a leaf spring contact surface surrounding said cutout and forming a frame for supporting said leaf spring for movement of said leaf spring into engagement with said free end of said striker spring for deflecting said striker spring toward said pretensioned position, together with said release lever, said frame not supporting said leaf spring against movement of said striker spring from said starting device to said rest position.

4. A device for actuating a starting device of an oxygen-releasing cartridge, the cartridge supplying oxygen for respiration, comprising: as respirator receiving housing, said respirator receiving housing accommodating said oxygen-releasing cartridge; a mounting support fastened to said respirator receiving housing; a striker spring fastened to said mounting support and extending in a cantilevered manner; a striking hammer disposed at a free end of said striker spring, said striker spring being deflectable from a starting position to a cocked, pretensioned position allowing movement of said striker spring free end to a striking position, adjacent to said starting device, thereby moving said striker hammer for actuating the starting device, said striker spring returning to said rest position; a fixed axis member mounted to said respirator receiving housing; and release lever means including a release member mounted on said fixed axis member for pivoting from a starting position toward a striker spring pretensioned position, said release lever means including a tensioning tongue movable with said release lever and a leaf spring connected to said tensioning tongue, said release lever means for moving said striker spring from said rest position to said pretensioned position upon pivoting from said starting position toward said pretensioned position, said release lever means including a return member connected to said release lever for automatically restoring said release lever to said starting position and including passage means for passage of said striker spring free end from said striking position to said rest position, whereby said starting device may be actuated more than one time.

* * * * *